United States Patent [19]

Englund

[11] 4,453,484

[45] Jun. 12, 1984

[54] HULL OF A BOAT, PROVIDED WITH KEEL AND RUDDER

[76] Inventor: Erik Englund, Lysgatan 14, S-802 36 Gävle, Sweden

[21] Appl. No.: 316,848

[22] Filed: Oct. 30, 1981

[30] Foreign Application Priority Data

Nov. 5, 1980 [SE] Sweden ..... 8007760

[51] Int. Cl.[3] ..... B63B 41/00

[52] U.S. Cl. ..... 114/143; 114/162

[58] Field of Search ..... 114/126–143, 114/123, 39, 144 R, 162, 165, 169

[56] References Cited

U.S. PATENT DOCUMENTS

| | | | |
|---|---|---|---|
| 276,026 | 4/1883 | Goodrich | 114/137 |
| 404,626 | 6/1889 | Hunt | 114/162 |
| 558,575 | 4/1896 | Smith | 114/137 |
| 713,830 | 11/1902 | York | 114/137 |
| 2,726,621 | 12/1955 | Hill | 114/162 |
| 4,016,824 | 4/1977 | Thyvold | 114/165 |

*Primary Examiner*—Galen L. Barefoot
*Assistant Examiner*—Jesus D. Sotelo
*Attorney, Agent, or Firm*—Kinzer, Plyer, Dorn & McEachran

[57] ABSTRACT

A hull (8) of a boat, having a keel (9) and a rudder (10). Both the rudder and the keel can be swung about an axis (14) extending in the longitudinal direction of the hull.

2 Claims, 6 Drawing Figures

HULL OF A BOAT, PROVIDED WITH KEEL AND RUDDER

The present invention relates to the hull of a boat, preferably a sailing boat, said hull having a keel and a rudder, said rudder being arranged to be swung about an axis extending longitudinally of the hull by means of operating means arranged to hold the rudder in a substantially vertical plane irrespective of the heeling angle of the hull, and said keel being swingable about an axis extending in the longitudinal direction of the hull.

It is well known that the rudder action can be amplified quite substantially by arranging for the rudder to swing not only around the rudder post but also around said axis, in order to prevent the sailing boat from going up against the wind. The favourable effect afforded by this arrangement, however, is limited to an area of moderate heel, for example a heel of 20°, and when the hull heels at transverse inclinations which are greater than moderate it is impossible to prevent the boat from going up against the wind even when the rudder is hard over. The reason why the rudder action is not fully efficient, despite the fact that the rudder is set vertically, is because the actual lateral plane centre of the boat is progressively displaced forwardly relative to a geometric lateral plane centre, i.e. the centre determined in a vertical plane extending through the central fore-and-aft line of the hull when there is no heel. Since, in the case of a sailing boat, the pressure centre of the area of the sail can, for practical purpose, be considered relatively immobile, this means that a turning moment is created when the lateral plane centre moves forward, and in the case of a normal sailing boat it also means that this turning moment will strive to rotate the hull to windward. As the angle of heel increases the turning moment also increases, and becomes so large that even a vertically suspended rudder is unable to hold the hull in a balanced state. Consequently, rudders which can be swung about an axis extending in the fore-and-aft direction of the vessel have not come into practical use because they are not able to improve steering ability to any great extent when such improvement is most needed, i.e. when the vessel heels at a sharp angle.

A prime object of the present invention is therefore to provide a hull of the kind described in the introduction in which forward displacement of the lateral plane centre is eliminated or at least reduced to an extent such that the weather helm does not increase, or at least only to an insignificant extent, when the hull heels. This means that the rudder need not be moved as hard over as otherwise would be the case and as a result hereof the braking effect of the rudder will be insignificant while the boat's leeway can be kept to the least possible level. Because the lateral plane centre is prevented from moving forward, it is also possible to hold substantially the same angle into the wind as if the boat were sailing fully upright.

This object is realized with the invention defined in the following claims and hereinafter described.

The invention is illustrated in the accompanying drawings, in which

Figure 1:
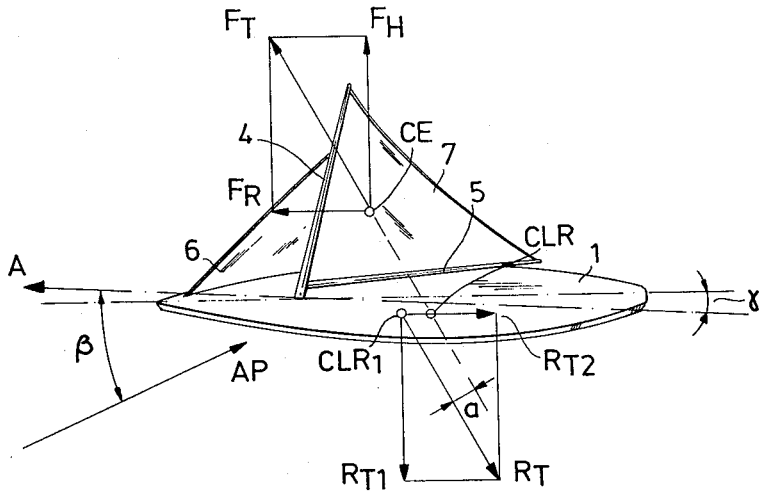
FIG. 1 illustrates a conventional sailing boat seen in a vertical plane.
Figure 2:
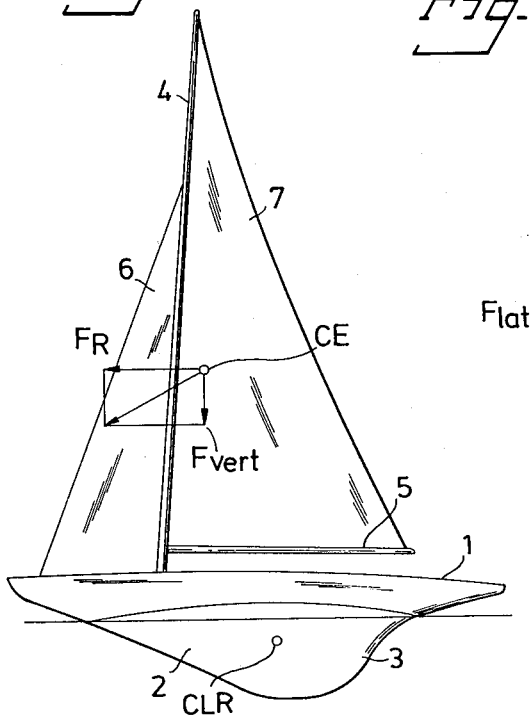
FIG. 2 is a side view of the sailing boat illustrated in FIG. 1.
Figure 3:
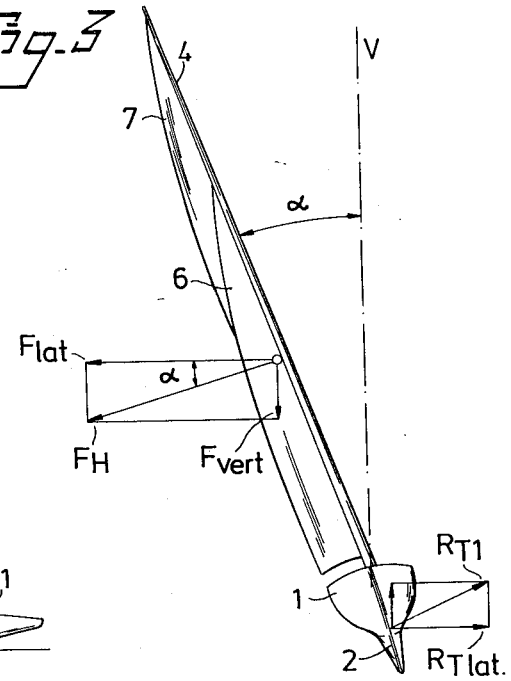
FIG. 3 is a front view of the sailing boat illustrated in FIGS. 1 and 2.

FIGS. 1-3 illustrate a sailing boat which is tacking close to the wind and thus heeling at an angle $\alpha$. The hull 1 of the sailing boat has a fixed keel 2 and a swingable rudder 3 mounted behind the keel. The illustrated boat has a mast 4, a boom 5, a foresail 6 and a mainsail 7. Seen in a vertical plane V when the boat is on an even keel, the surface lying beneath the surface of the water projected on the vertical plane has a geometric lateral plane centre CLR and the area of sail, comprising the foresail 6 and the main sail 7 has a pressure centre CE. The aerodynamic force $F_T$ generated by the apparent wind AP can be considered to act in the centre of effort CE, and the hydrodynamic force $R_T$, created as a result of the forward movement of the boat in direction A while the boat has a certain leeway $\gamma$, acts in the centre of lateral resistance CLR. The boat is fully balanced with $F_T$ and $R_T$ lie on a line through CE and CLR. If one makes the normal approximation that CE lies constant at varying degrees of heel and knows that the actual CLR lies at a distance a in front of the geometric CLR, it will be seen from FIG. 1 that when the boat heels a turning moment is created, i.e. the boat carries weather helm, and that this turning moment increases with an increasing heeling angle $\alpha$, since the actual CLR is moved further forward relative to the geometric CLR.

In order for the sailing boat to be held on its course A and move forward through angle $\beta$ in relating to the apparent wind AP, the rudder must be turned to leeward, which means that a counteracting force will be created. As a result, the speed will decrease, which in turn causes the resultant hydrodynamic force $R_T$ to decrease. If the total aerodynamic force $F_T$ in FIG. 1 is divided into a heeling force $F_H$, which acts at right angles to the centre plane of the boat, and a propelling force $F_R$, which acts in the direction of travel A, and the heeling component $F_H$ is then divided into a horizontal lateral force $F_{lat}$ (FIG. 3) and a vertical force $F_{vert}$, and a corresponding division is made of the hydrodynamic force $R_T$, there is obtained a force $R_{Tlat}$ which is opposite in directional sense to the force $F_{lat}$. The force $R_{Tlat}$ decreases with increasing heel because of increasing resistance, while the force $F_{lat}$ remains substantially constant. The leeway $\gamma$, determined by $F_{lat}$ and $R_{Tlat}$, will thus increase.

Thus, heeling of a boat having a fixed keel will cause the lateral plane centre to be displaced, which results in a weather helm which must be compensated by increasing the rudder. This increase in the rudder will cause the speed of the boat to drop, resulting in a decrease in the hydrodynamic force and an increased leeway.

The aforedescribed conditions are well known, and a deeper analysis is not therefore necessary.

It will be obvious, however, that if it were possible to prevent displacement of the geometric centre CLR of the lateral plane when the boat heeled, it would be possible firstly to maintain maximum boat speed, secondly to sail close to the wind, since the apparent wind, which generates the force $F_R$, is dependent on the speed of the boat, and thirdly to keep the leeway angle $\gamma$ to a minimum. This stabilization of the lateral plane centre can be achieved in accordance with the invention by holding the area of the keel projected onto a vertical plane, or at least a major part of said area, constant, i.e. making the keel swingable, so that said keel can be held vertical together with the rudder, even when the boat heels steeply. The force $R_T$ will thus lie in a horizontal direction and be equal to the leeway-preventing force $R_{Tlat}$, enabling the abovementioned theoretical, favourable properties of a rudder which stands vertically to be utilized to the full, i.e. the braking effect will be minimal.

Figure 4:
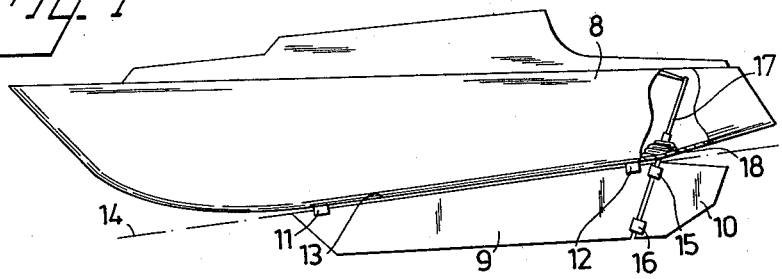
FIG. 4 illustrates a hull according to the invention in sideview.
Figure 5:
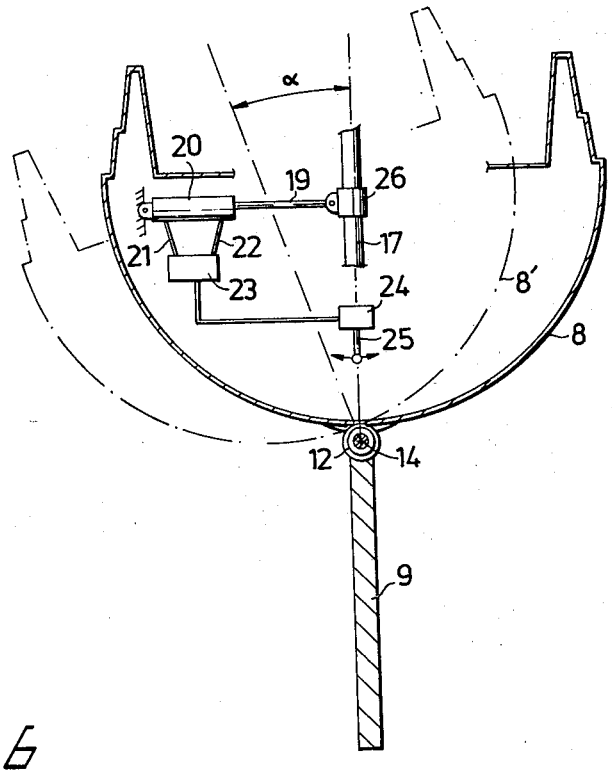
FIG. 5 is a sectional view taken thwartships of the hull shown in FIG. 1.

FIG. 4 is a side view of a hull 8 having a keel 9 and a rudder 10. The keel 9, which may be provided with ballast (not shown), for example in the form of a lead bulb extending along the bottom edge of the keel 9, is suspended from two bearings 11 and 12 along the bottom 13 of the boat and in a vertical plane through the centre line of said boat. The two rotary bearings 11 and 12 have a common rotary or pivot axis 14 around which the keel 9 can thus be swung, as illustrated in FIG. 5, from which FIG. it will be seen that the keel 9 can be held in a vertical position when the hull 8 heels from an upright position to the heeling position 8'. As will be seen from FIG. 4, the rudder 10 of the illustrated embodiment is fixed to the rear or trailing edge of the keel 9 by pivots 15 and 16. These pivots may comprise, in the normal manner, pintle sockets or gudgeons attached to the rudder and pintles attached to the keel 9. The two pivots 15,16 have a common pivot axis which coincides with the centre axis of the rudder post 17 on which the rudder is mounted. The rudder post 17 extends through an opening (not shown) which is elongate in the thwartships direction, so that the rudder post can swing thwartships together with the rudder 10 and the keel 9. In the illustrated embodiment a rubber bellows-like structure 18 seals against the inside of the hull and against the rudder post 17. If desired drive means can be provided for imparting a swinging movement to the rudder post 17, so as to place the rudder and keel in a vertical position. Such an arrangement is illustrated schematically in FIG. 5, and includes a double-acting piston-cylinder device 19,20. One end of the cylinder 20 is swingably mounted onto the inside of the hull, while the outer end of the piston is pivotably connected to a sleeve 26 or like element on the rudder post 17, said sleeve enabling the rudder post to rotate about its axis. The cylinder 20 is connected to a pump means 23 for pressure medium by means of two pressure-medium lines 21 and 22, and the supply direction of the pump is controlled by a position sensor 24 arranged to send control signals to the pump 23, in response to a pendulum 25, therewith to move the rudder post 17 to port or to starboard.

In certain cases it may be convenient to be able to turn the keel and the rudder independently of one another, in which case different positions of rotation relative to the vertical enable the actual lateral plane centre CLR (FIG. 1) to be trimmed. In view hereof, separate rotating means are provided for rotating the keel. The two longitudinally extending rotation axes need not, in this case, coincide with one another and, of course, the rudder is not hung on the keel.

Figure 6:
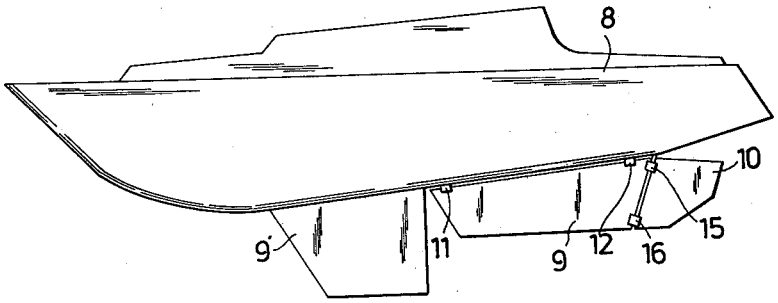
FIG. 6 is a side view of a further hull according to the invention.

FIG. 6 illustrates a modified embodiment, in which the keel is divided into two parts, namely a fixed, ballasted keel part 9' and a somewhat shortened swingable keel part 9. Such a division of the keel may provide the desired stabilization of CLR, depending upon the design of the hull, but the surface area of the fixed keel 9' should be less than 50% of the surface area of the swingable keel 9.

Other modifications to the illustrated arrangements are conceivable within the scope of the claims. For example, the pivots 11 and 12 and the upper edge of the keel 9 may suitably be placed in a groove in the hull, so as to obtain the best possible flow conditions.

I claim:

1. A combined keel and rudder for a sail boat having a hull, including:

a keel mounted on the hull for rotation of the keel about an axis extending in the longitudinal direction of the hull, a rudder mounted on the keel for rotation about said axis extending in the longitudinal direction of the hull, and means for swinging the keel and rudder in unison to selected positions on either side of said axis extending in the longitudinal direction of the hull in order to counteract displacement of the center of lateral resistance of the hull when the hull heels.

2. The combined keel and rudder of claim 1 in which the means for swinging the keel and rudder in unison to selected positions on either side of said axis extending in the longitudinal direction of the hull include a rudder post and driving means attached to the rudder post for moving the rudder post about said axis extending in the longitudinal direction of the hull.

* * * * *